US010797369B2

(12) United States Patent
Milroy et al.

(10) Patent No.: US 10,797,369 B2
(45) Date of Patent: Oct. 6, 2020

(54) ARRAYED WAVEGUIDE-TO-PARALLEL-PLATE TWIST TRANSITION WITH HIGHER-ORDER MODE OPTIMIZATION

(71) Applicant: ThinKom Solutions, Inc., Hawthorne, CA (US)

(72) Inventors: William Milroy, Torrance, CA (US); Shahrokh Hashemi-Yeganeh, Rancho Palos Verdes, CA (US)

(73) Assignee: THINKOM SOLUTIONS, INC., Hawthorne, CA (US)

( * ) Notice: Subject to any disclaimer, the term of this patent is extended or adjusted under 35 U.S.C. 154(b) by 0 days.

(21) Appl. No.: 16/015,232

(22) Filed: Jun. 22, 2018

(65) Prior Publication Data

US 2019/0393577 A1 Dec. 26, 2019

(51) Int. Cl.
*H01P 1/02* (2006.01)
*H01P 3/123* (2006.01)

(52) U.S. Cl.
CPC ..... *H01P 1/025* (2013.01); *H01P 3/123* (2013.01)

(58) Field of Classification Search
CPC .. H01P 1/02; H01P 1/025; H01P 3/123; H01P 3/12; H01P 3/16
USPC ..... 333/239, 248, 249
See application file for complete search history.

(56) References Cited

U.S. PATENT DOCUMENTS 2,761,137 A * 8/1956 Atta ..... H01P 3/122 343/771
6,563,398 B1 * 5/2003 Wu ..... H01Q 21/0037 333/137
2002/0021184 A1 2/2002 Rosenberg et al.
2004/0246062 A1 12/2004 Asao et al.
2015/0123862 A1 * 5/2015 Milroy ..... H01P 1/025 343/776

OTHER PUBLICATIONS

Extended European Search Report issued in connection with related European Patent Application No. 19181195.9, dated Oct. 18, 2019.

(Continued)

*Primary Examiner* — Robert J Pascal
*Assistant Examiner* — Kimberly E Glenn
(74) *Attorney, Agent, or Firm* — Kusner & Jaffe

(57) ABSTRACT

A waveguide-to-parallel-plate twist transition includes at least one waveguide-to-parallel plate twist transition element comprising an input port comprising an input waveguide portion, the input waveguide portion configured to orient an E-field of an electromagnetic wave along a first plane, and an output port comprising a multi-mode parallel plate portion, the multi-mode parallel plate portion configured to orient an E-field of an electromagnetic wave along a second plane, wherein an angle of orientation of the second plane is different from an angle of orientation of the first plane. The twist transition further includes at least one intermediate discrete twist waveguide stage coupling each input waveguide portion to the output multi-mode parallel plate portion, wherein at least one intermediate discrete twist waveguide stage is configured to orient an E-field of an electromagnetic wave along a third plane, wherein an angle of orientation of the third plane is between the angle of orientation of the first plane and the angle of orientation of the second plane.

16 Claims, 7 Drawing Sheets

(56) References Cited

OTHER PUBLICATIONS

Munir et al., "Rectangular to Parallel Plate Waveguide Transition and its Tapering Effect for iMicrowave Devices Characterization, " International Journal on Electrical Engineering and Informatics, vol. 6, No. 1, Mar. 30, 2014, pp. 181-194.
Rengarajan, "Excitation of a Parallel Plate Waveguide by an Array of Rectangular Waveguides," Electromagnetics., vol. 31, No. 2, Jan. 31, 2011, pp. 101-116.
Alonso-Juaristi et al., "Design of Compact Waveguide Twists," IEEE Transactions on Microwave Theory and Techniques, Plenum, USA, vol. 45, No. 5, May 1, 1997.
Meinke et al., "Verdrehte Übergänge mit Rechteckleiter," In: "Taschenbuch der Hochfrequenztechnik, zweite Auflage," Jan. 1, 1962, Springer Verlag Berlin Heidelberg GmbH, pp. 399-401, including English language machine translation.
Sikora et al., "The Art and Science of Manufacturing Waveguide Slot-Array Antennas," Microwave Journal, Horizon House Publications, Norwood, MA, US, vol. 31, No. 6, Jun. 1, 1988, pp. 157-160, and 162.
You et al., "Design of a 4 X 4 Low Profile Continuous Transverse Stub Antenna Array," 2017 Progress in Electromagnetics Research Symposium—Fall (Piers-Fall), IEEE, Nov. 19 Nov. 2017, pp. 1465-1469.

* cited by examiner

ARRAYED WAVEGUIDE-TO-PARALLEL-PLATE TWIST TRANSITION WITH HIGHER-ORDER MODE OPTIMIZATION

TECHNICAL FIELD

The present disclosure relates generally to antennas, and more particularly to methods for creating an efficient and broad band transmission from a waveguide transmission line to a parallel-plate transmission line.

BACKGROUND ART

Planar (and other types of) antenna systems often require the antenna to fit into ever-shrinking available spaces while maintaining key performance characteristics, such as high ohmic efficiency and broad band operation. To achieve the desired performance, a hybrid combination of parallel-plate and waveguide designs are often used as propagation media due to their superior bandwidth and ohmic efficiency characteristics. FIG. 1 illustrates a generic parallel-plate transmission line 10 and waveguide transmission line 12. The parallel-plate transmission line is defined by an upper conductive plate 10*a* and a lower conductive plate 10*b* arranged parallel to the upper conductive plate. The waveguide transmission line 12 is defined by an enclosed region having two narrow walls 12*a* arranged opposite one another, and two wide (broad) walls 12*b* arranged opposite one another, the narrow and wide (broad) walls joined together to define a volume.

The waveguide portion is usually deployed (arrayed) in a corporate feed, traveling-wave feed, standing-wave feed, or other structure where multiple outputs are coupled to a common parallel-plate section. To support the hybrid combination of transmission lines and support efficient performance over a wide frequency bandwidth (including the effects of higher-order modes associated with the mutual coupling between adjacent/proximal waveguide outputs), a coupling transition is provided between the two media.

A typical method for transitioning from waveguide to parallel plate involves the use of a tapered horn, but such devices are typically quite large and difficult to package. Another method for transitioning from parallel plate to a waveguide corporate feed network in which multiple waveguide outputs have been generated using E-plane power dividers (Tees) involves the attachment of multiple separate (flanged) waveguide twist components. This approach has its drawbacks in terms of packaging size, manufacturing complexity, and cost, and these drawbacks become even more pronounced as operating frequencies are increased.

Referring to FIG. 2, illustrated is a conventional structure 20 for transitioning from a waveguide transmission line 12 to a parallel-plate transmission line 10, the respective transmission lines being located on the same plane and E-fields orthogonal to one another. The waveguide transmission line 12 includes a waveguide feed input 22 for receiving an RF signal, and a waveguide corporate feed 24 coupled to the feed input 22. The waveguide corporate feed 24 includes a plurality of feed paths branching off from the waveguide feed input 22. A flange 26 or other mounting means is coupled to respective output ports of the waveguide corporate feed 24 to facilitate attachment of the waveguide transmission line 12 to another structure. The flange 26 includes a plurality of openings (not shown in FIG. 2), each opening corresponding to an output port of the corporate feed structure.

A parallel plate transmission line 10 includes an upper plate 10*a* and a lower plate 10*b* generally parallel to the upper plate, the upper and lower plates defining the transmission line. A flange 30 or other mounting means is connected to the upper and lower plates to facilitate attachment of the parallel plate structure to another structure. The flange 30 includes an opening (not shown in FIG. 2) corresponding to a separation (gap) between the upper and lower plates 10*a*, 10*b*.

Coupling the waveguide transmission line 12 to the parallel plate transmission line 10 are a plurality of waveguide twist structures 40. Each waveguide twist structure 40 may include input and output flanges 46, 48 or other mounting means for coupling the waveguide twist structure 40 to the waveguide transmission line flange 26 and the parallel plate transmission line 10 flange 30.

FIG. 3 shows another conventional method for transitioning waveguide to parallel-plate when such transmission media are located in the same plane and their E-fields are orthogonal to one another. The device 50 shown in FIG. 3 employs a tapered horn configuration having an input port 52 for connection to a waveguide transmission line (not shown in FIG. 3), and an output port 54 for connection to a parallel plate transmission line 10. A region 56 (tapered horn) between the input port 52 and the output port 54 is tapered to correspond to the respective ports 52, 54. A separate waveguide twist 57 is attached at the port 52 to provide the desired orthogonality of the E-fields at the port 58 as achieved in FIG. 2.

While the approaches shown in FIGS. 2 and 3 achieve the desired result, in a practical case where multiple waveguides or a tapered horn are used to feed a large parallel-plate region, feeding such a structure may be a challenge in the available space (which is usually confined to the total area provided by the product). Further, multiple Twist Waveguide structures add undesired depth and length to the parallel plate and waveguide ensemble.

The tapered horn approach typically requires too much product area to effectively package, and the separately attached twist component requires a significant amount of product thickness to allow for fitting the requisite waveguide flange. In addition, tapered horns can suffer from dimensional variation over the large, unsupported area of the device. Such dimensional variation can result in phase errors and degraded performance. In some cases tapered horns can be folded over to make the device more compact, mitigating the effect of dimensional variation, but this also has the negative effect of making the device thicker and more expensive to fabricate.

SUMMARY OF INVENTION

A Waveguide-to-Parallel-Plate Twist Transition device in accordance with the present disclosure offers a compact, integrated method of transitioning from one transmission line media to the other. The device can incorporate E-field twist features into the same fabricated element containing a parallel plate and waveguides of a corporate feed. Further, through selective control of parallel-plate transmission-line modes (favoring lower modes over higher modes) traditional dispersion limitations associated with parallel-plate structures are avoided.

According to one aspect of the invention, a waveguide-to-parallel-plate twist transition includes at least one waveguide-to-parallel plate twist transition element including i) an input port having an input waveguide portion, the input waveguide portion configured to orient an E-field of an electromagnetic wave along a first plane, ii) an output port including a multi-mode parallel plate transmission line portion, the multi-mode parallel plate transmission line portion configured to orient an E-field of an electromagnetic wave along a second plane, wherein an angle of orientation of the second plane is different from an angle of orientation of the first plane, and iii) at least one intermediate discrete twist waveguide stage coupling the input waveguide portion to the output multi-mode parallel plate transmission line portion. At least one intermediate discrete twist waveguide stage is configured to orient an E-field of an electromagnetic wave along a third plane, wherein an angle of orientation of the third plane is between the angle of orientation of the first plane and the angle of orientation of the second plane.

Optionally, the at least one waveguide-to-parallel plate twist transition element includes at least two waveguide-to-parallel plate twist transition elements arranged adjacent to one another.

Optionally, the first plane is orthogonal to the second plane.

Optionally, the at least one waveguide-to-parallel plate twist transition element includes a plurality of intermediate discrete twist waveguide stages, and each intermediate discrete twist waveguide stage of the plurality of intermediate discrete twist waveguide stages is configured to orient an E-field of an electromagnetic wave along a respective plane, wherein for each intermediate discrete twist waveguide stage an angle of orientation of the respective plane is different from an angle of orientation of other planes of the plurality of intermediate discrete twist waveguide stages.

Optionally, each intermediate discrete twist waveguide stage orients the E-field at (K/(1+N)) degrees relative to an E-field orientation of an immediately adjacent intermediate discrete twist waveguide stage, where K is the angle between the input port and the output port and N is the number of intermediate discrete twist waveguide stages.

Optionally, the at least one intermediate discrete twist waveguide stage orients the E-field at 45 degrees relative to an orientation of the E-field for an immediately adjacent input port or output port.

Optionally, at least one intermediate discrete twist waveguide stage includes at least one of a rectangular or elliptical waveguide.

Optionally, the waveguide to parallel plate twist transition is formed in a plate structure.

Optionally, the plate structure includes a first plate portion and a second plate portion removably attachable to the first plate portion.

Optionally, A first portion of the input port, a first portion of the output port and a first portion of the at least one intermediate discrete twist waveguide stage are each formed in the first plate structure, and wherein a second portion of the input port, a second portion of the output port and a second portion of the at least one intermediate discrete twist waveguide stage are each formed in the second plate structure.

Optionally, the input waveguide portion, intermediate discrete twist waveguide stages, and the output parallel plate portion are formed in a dielectric material.

Optionally, interior walls of the input waveguide portion, output parallel plate portion and the at least one intermediate discrete twist waveguide stage include a metal plating.

Optionally, a parallel-plate transmission line is formed integral with the plurality of waveguide-to-parallel plate twist transition elements.

Optionally, a B-dimension of the parallel plate transmission line is different from a B-dimension of the parallel plate on the output port of the waveguide-to-parallel-plate twist transition elements.

Optionally, the output port includes an output waveguide portion arranged between the at least one intermediate discrete twist waveguide stage and the multi-mode parallel-plate transmission line portion, the output waveguide portion having the same E-field orientation as the multi-mode parallel plate transmission line portion and coupling the at least one intermediate discrete twist waveguide stage to the multi-mode parallel-plate transmission line portion.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

When a waveguide transmission line is located in the same plane (level) as a parallel plate transmission line and the E-fields of both transmission lines are orthogonal to each other, and the waveguide transmission line is required to carry a relatively wide band or two widely separated bands, a common practice for transitioning RF power between the waveguide transmission line and the parallel-plate transmission line is through a waveguide twist transition or a tapered horn transition. However, and as noted above, such methods result in a device requiring a large package, high complexity and/or high costs.

Figure 1:
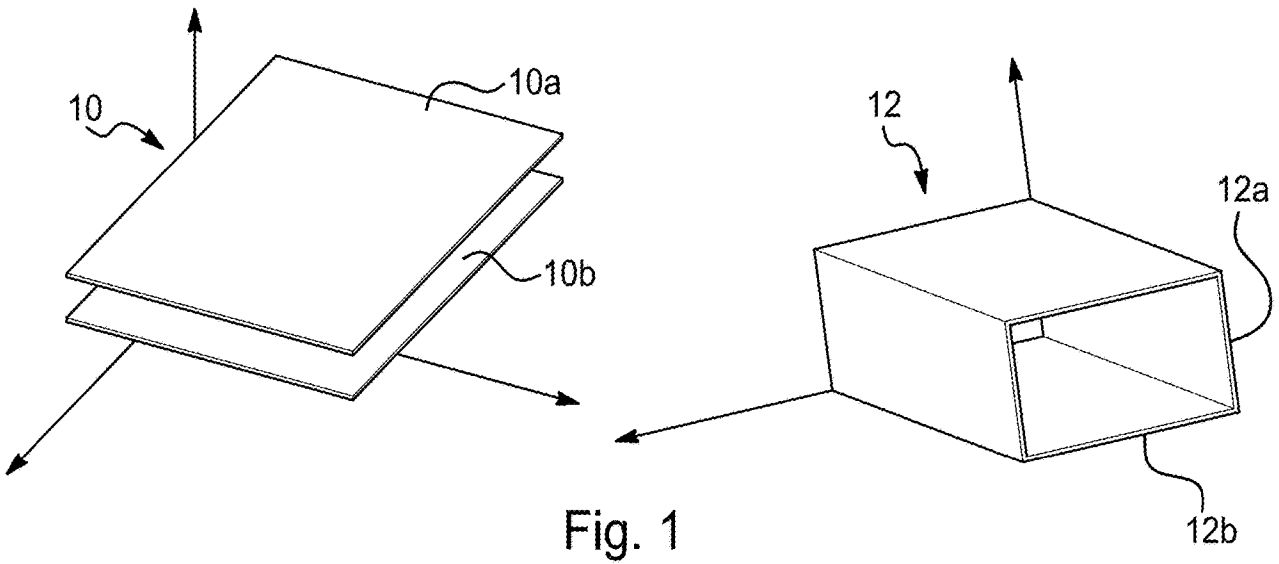
FIG. 1 illustrates a generic parallel-plate transmission line and a generic waveguide transmission line.
Figure 2:
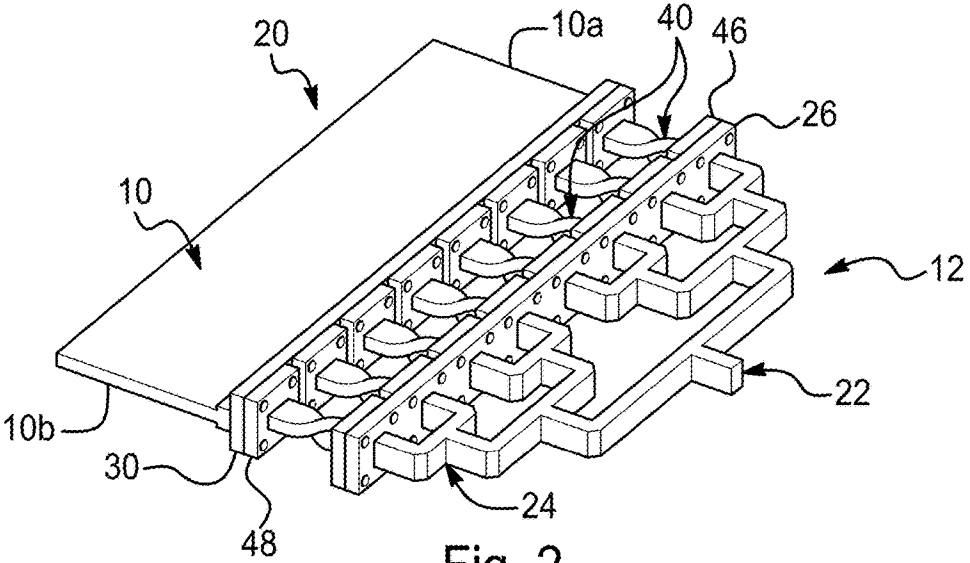
FIG. 2 illustrates a conventional multiple twist waveguides feeding a rectangular parallel-plate transmission line.
Figure 3:
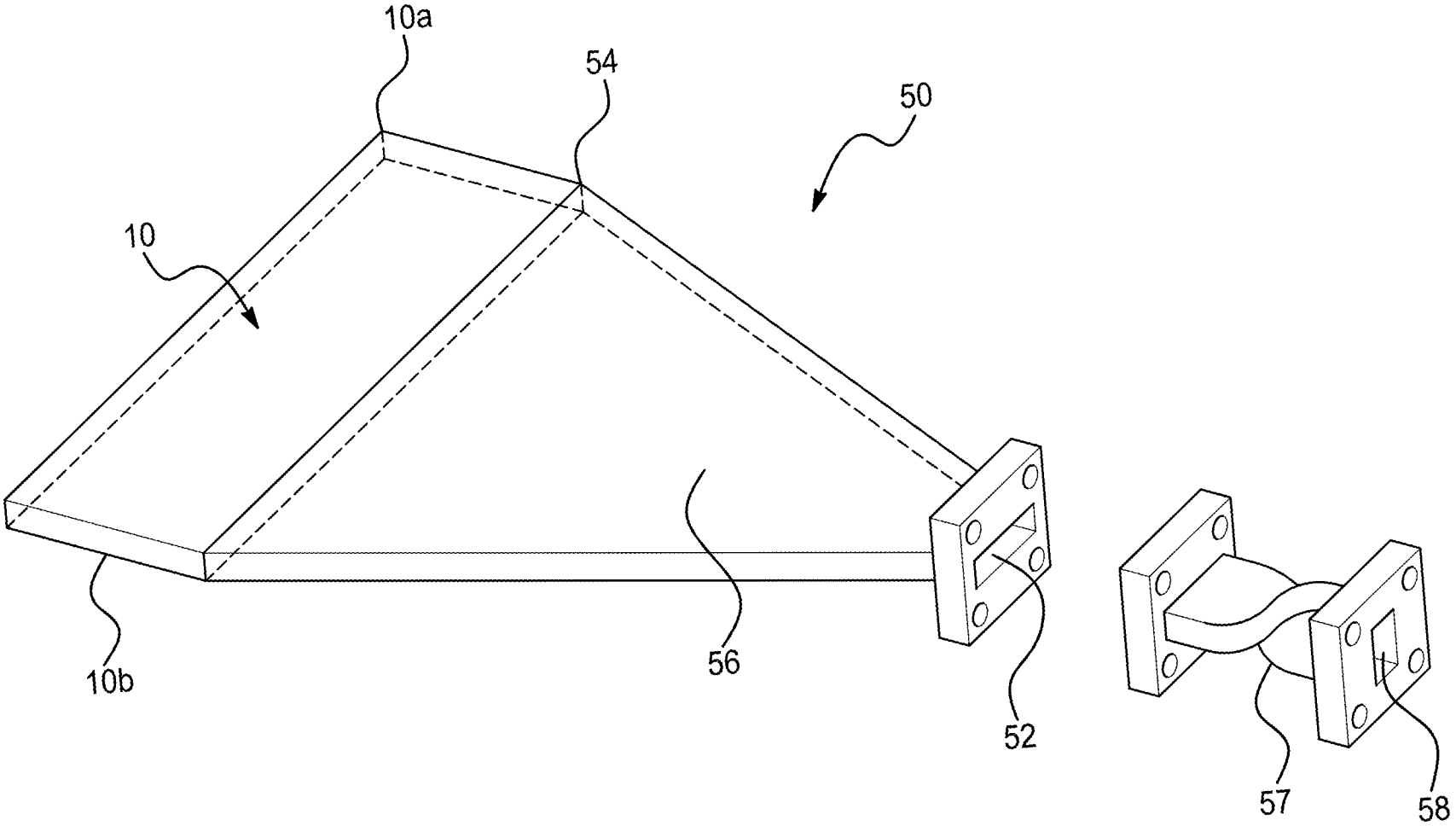
FIG. 3 illustrates a conventional tapered horn feeding a rectangular parallel-plate transmission line.

For example, FIG. 2 illustrates the complexity of a waveguide transition in the form of multiple twist waveguides at the output of the waveguide feed network, while FIG. 3 illustrates how a substantial packaging volume is required to effect a transition from parallel plate transmission line to a waveguide transmission line via the use of a tapered horn.

The device and method in accordance with the present disclosure creates an efficient broad band transmission from a waveguide transmission line to a parallel-plate transmission line. Further, specific unique properties of novel embodiments in accordance with the present disclosure provide potential weight savings, space savings, and reduced design complexity relative to conventional solutions.

A waveguide-to-parallel-plate twist transition in accordance with the present disclosure offers a compact, integrated method of transitioning from a parallel-plate transmission line to a waveguide transmission line, an E-field of the waveguide transmission line being orthogonal to that of the parallel-plate transmission line. In this manner, a more compact, less tolerance-sensitive corporate feed can be used that does not require a labor-intensive joining processes such as conductive bonding or brazing. The waveguide-to-parallel-plate twist transition in accordance with the present disclosure provides the additional benefit of increased ohmic efficiency, reduced part count (and cost), and reduced package size.

Unlike tapered horns, the waveguide-to-parallel-plate twist transition in accordance with the present disclosure is compact and enables use of compact corporate feed networks. Further, unlike discrete waveguide twist components the waveguide-to-parallel-plate twist transition in accordance with the present disclosure can be integrated with the parallel-plate and corporate feed transitions, which allows the waveguide-to-parallel-plate twist transition to be incorporated into the same manufactured part(s) that form these transmission media. The waveguide-to-parallel-plate twist transition in accordance with the present disclosure is advantageous in that it mitigates the packaging and manufacturing limitations of traditional horn transitions and discrete waveguide twist components while providing improved ohmic efficiency. In addition, the device and method in accordance with the invention can uniquely exploit the mutual coupling induced higher-order waveguide modes associated with the close packing/proximity of adjacent waveguide outputs as they couple into the parallel plate. Absent this exploitation, the impedance match of individual "embedded" waveguide ports would generally be poor (high reflections) thereby limiting the utility of the twist-transition structure.

Figure 4:
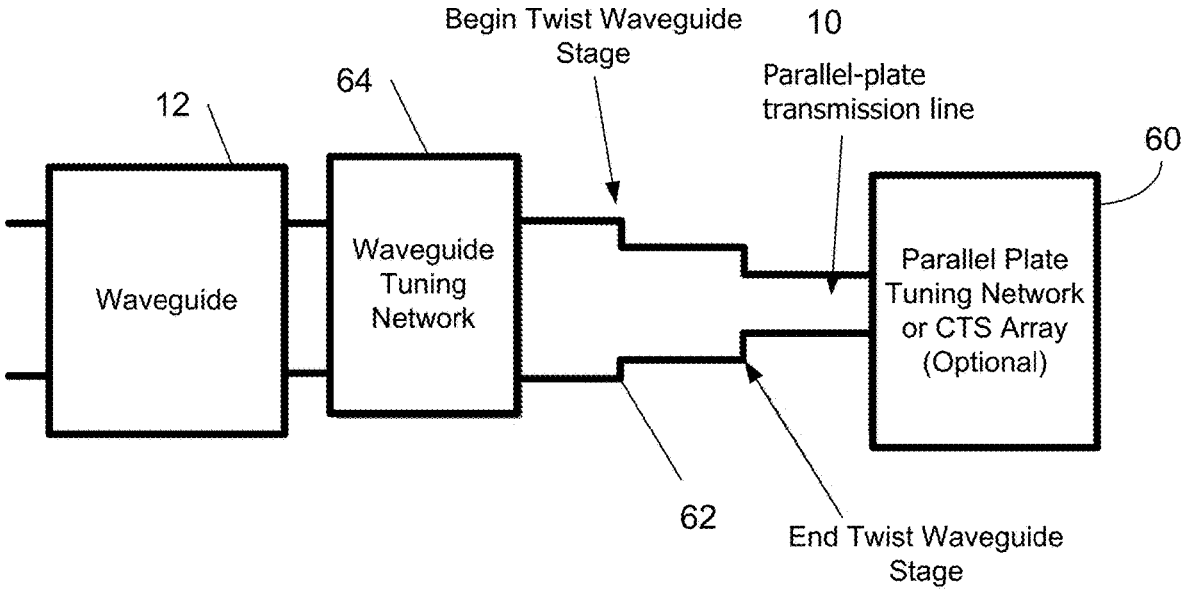
FIG. 4 is a block diagram of an exemplary waveguide twist transition in accordance with the present disclosure.

Referring now to FIG. 4. Illustrated is a block diagram of a waveguide-to-parallel-plate twist transition in accordance with the present disclosure. In the illustrated embodiment, a waveguide 12 is coupled to a waveguide tuning network 64 comprising at least two waveguide ports each of which is in turn coupled to a parallel plate transmission line 10 via a waveguide-to-parallel-plate twist transition element 62 in accordance with the present disclosure. The waveguide tuning network 64, which may include at least one waveguide input, is arranged between the waveguide 12 and each waveguide-to-parallel-plate twist transition element 62. A twist function of the exemplary waveguide-to-parallel-plate twist transition element 62 is formed from a single input port and a single output port and effects the transition between each waveguide of the tuning network 64 and the parallel plate 10. A linear array of such twist elements in conjunction with the multi-waveguide tuning network 64 is employed to transition the single waveguide input port 12 to the (wider) parallel-plate transmission line 10. An output port of the parallel-plate transmission line 10 can operate as a single radiating element (parallel-plate line source) or act as an input to a full CTS or VICTS antenna array of radiating elements.

Figure 5A:
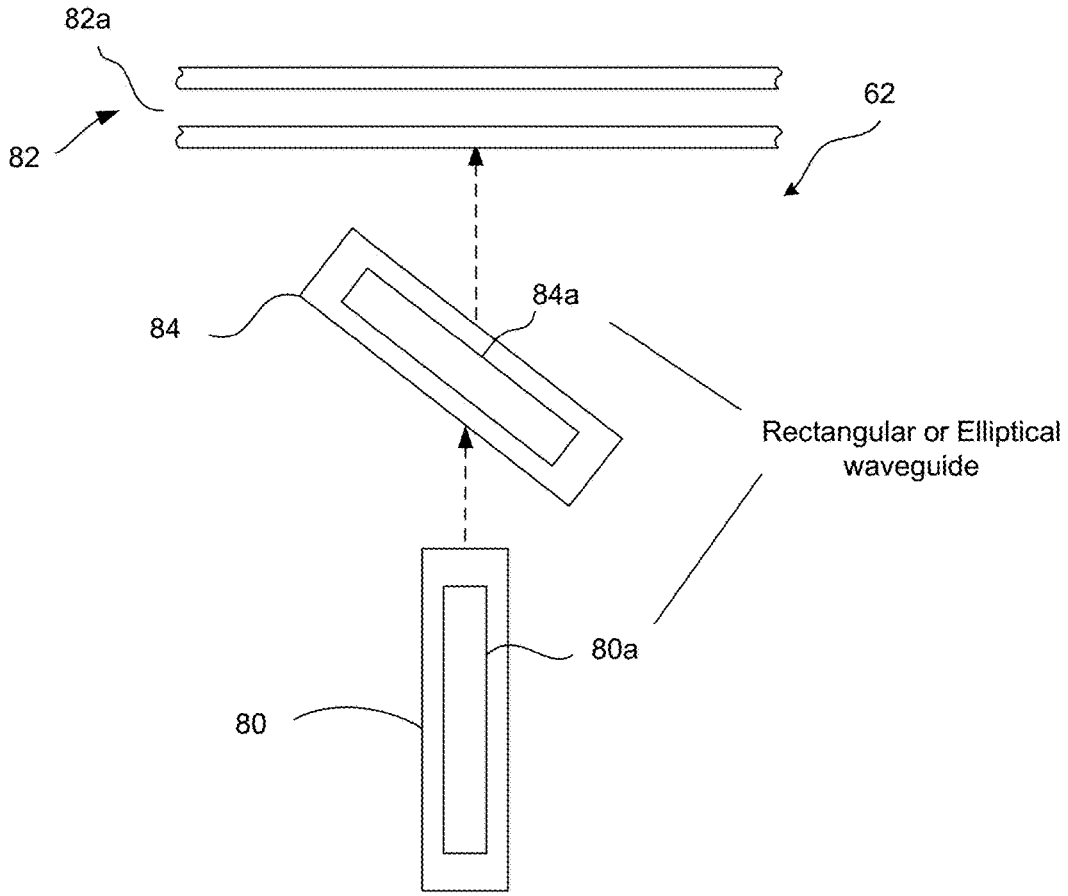
FIGS. 5A and 5B are simplified schematic diagrams illustrating a stepped transition of a waveguide twist transition in accordance with the present disclosure.
Figure 5B:
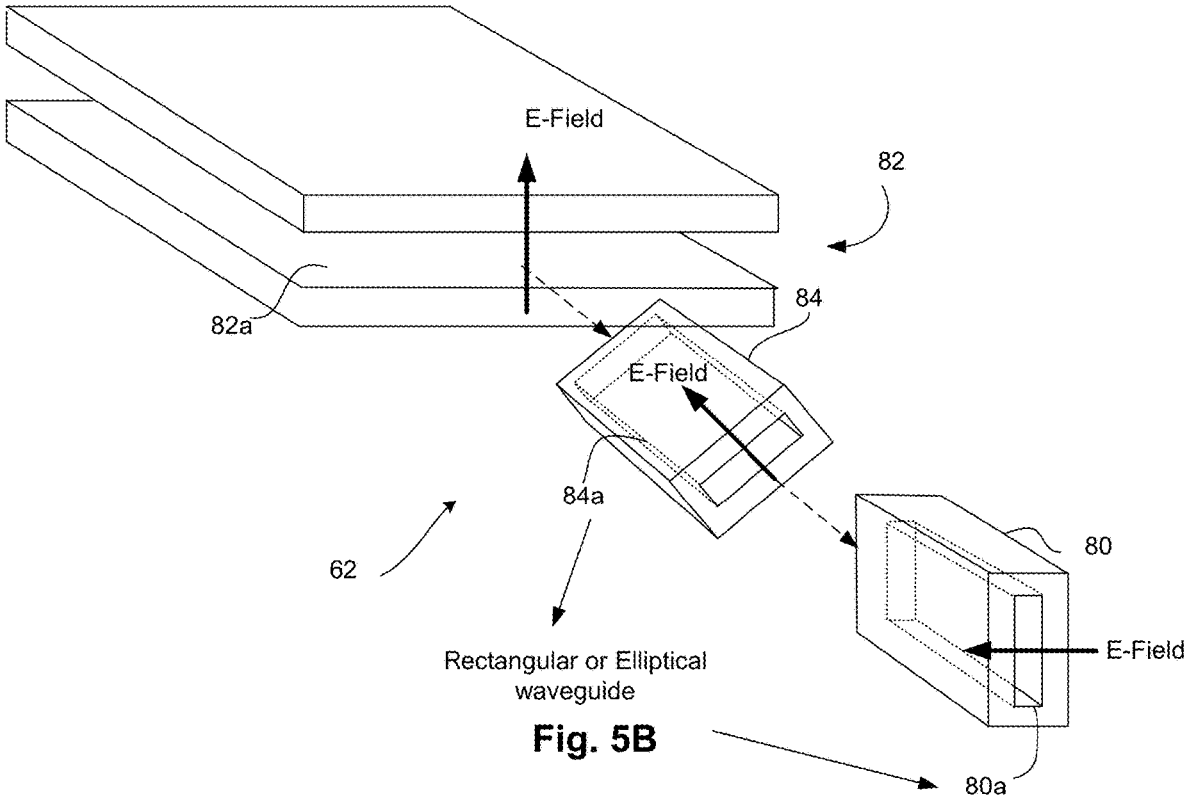

With reference to FIGS. 5A and 5B, illustrated are simple schematic diagrams showing the concept of an intermediate discrete twist waveguide stage (also referred to as a waveguide twist transition or waveguide twist) for a waveguide-to-parallel-plate twist transition element 62 in accordance with the disclosure. For ease of understanding, the portions of the waveguide-to-parallel-plate twist transition element 62 are illustrated in FIGS. 5A and 5B as separate parts that are spaced apart from one another and/or in different positions. However, in practice the portions illustrated in FIGS. 5A and 5B are joined/adjacent to one another to form an integrated waveguide-to-parallel-plate twist transition element.

Functionally, a purpose of the waveguide-to-parallel-plate twist transition is to (1) behave in the desired frequency band as an array of matched low-loss 2-port devices (elements) transitioning the waveguide transmission line media to the open-structure parallel-plate transmission line media; and (2) in the desired frequency band, twist the E-field to allow for the use of lower-loss, lower cost waveguide feed network elements on the waveguide side of the transition.

The waveguide-to-parallel-plate twist transition element 62 includes an input port 80, an output port 82 and at least one intermediate discrete twist waveguide stage 84 arranged between the input port 80 and the output port 82. The input port 80 includes an input waveguide portion 80*a* that is configured to receive and/or orient an E-field of an electromagnetic wave along a first plane. For example, the first plane may be oriented to correspond to an E-field orientation of a received electromagnetic wave from a waveguide feed network. The output port 82 includes a multi-mode parallel plate transmission line portion 82*a* that is configured to output and/or orient an E-field of an electromagnetic wave along a second plane, where an angle of orientation of the second plane is different from an angle of orientation of the first plane. For example, the second plane may be oriented to correspond to an E-field orientation of an electromagnetic wave that is output by an array of output ports 82 (elements). In one embodiment, the first plane is orthogonal to the second plane. The output port 82 may further include an output waveguide portion coupled to the multi-mode parallel-plate portion, the output waveguide portion forming a connection means between the multi-mode parallel-plate portion and the at least one intermediate discrete twist waveguide stage 84.

As used herein, a multi-mode parallel-plate transmission-line is defined as a broad open structure, comprised of two separated similarly-sized conductive generally parallel plates/surfaces, each with transverse extent (physical width) that is generally greater than two free space wavelengths and generally eight times or greater than the physical separation between upper and lower conductive plates/surfaces. Unlike conventional dominant-/single-mode (TE10) "Rectangular Waveguide" structures, multi-mode parallel-plate structures support multiple simultaneous low-loss propagating modes (TE1, TE2, . . . and TM1, TM2, . . . ) which provide additional degrees-of-freedom (and design flexibility) for realization of more complex field distributions and applications (including antenna feed, diplexer, and filter devices) In addition, these structures are generally lower-cost to manufacture and lower in Radio Frequency (RF) loss as compared to rectangular waveguide-based structures.

The waveguide-to-parallel-plate twist transition element 62 also includes at least one intermediate discrete twist waveguide stage 84, which includes a waveguide 84*a* that couples the input waveguide portion 80*a* to the output parallel plate portion 82*a* (or to the output waveguide portion). As used herein, an intermediate discrete twist waveguide stage is defined as a waveguide portion that creates a step change in an orientation of the E-field created by the intermediate discrete twist waveguide stage relative to an orientation of the E-field created by an immediately adjacent waveguide, waveguide portion, or parallel plate. Such step change in orientation of the E-field is in contrast to a continuous change in orientation of the E-field as provided by the waveguide twists 40 described in FIG. 2. The intermediate discrete twist waveguide stage 84 may include a waveguide portion having a rectangular shape, an elliptical shape, or any other shape known in the art.

The waveguide 84*a* of the at least one intermediate discrete twist waveguide stage 84 is configured to orient an E-field of an electromagnetic wave along a third plane, where an angle of orientation of the third plane is between the angle of orientation of the first plane and the angle of orientation of the second plane. For example, if the first plane orients the E-field at 0 degrees and the second plane orients the E-field at 90 degrees, then the third plane orients the E-field between 0 degrees and 90 degrees, e.g., 45 degrees.

Preferably, the waveguide-to-parallel-plate twist transition element 62 includes a plurality of intermediate discrete twist waveguide stages 84, where each intermediate discrete twist waveguide stage 84 is configured to orient an E-field of an electromagnetic wave along a respective plane. More particularly, for each intermediate discrete twist waveguide stage 84 an angle of orientation of the respective plane is different from an angle of orientation of other planes of the plurality of intermediate discrete twist waveguide stages. For example, if the first and second planes are orthogonal to each other, three intermediate discrete twist waveguide stages 84 can be placed between the input port 80 and output port 82, where each intermediate discrete twist waveguide stage orients the E-field at 22.5 degrees relative to an orientation of the E-field for an immediately adjacent intermediate discrete twist waveguide stage and/or waveguide or parallel plate portion. This relationship between the E-field orientation of an intermediate discrete waveguide twist stage 84 relative to an immediately adjacent intermediate discrete waveguide twist stage 84 may be expressed as (K/(1+N)) degrees, where K is the E-field orientation in degrees between the input port 80 and the output port 82 and N is the number of intermediate discrete twist waveguide stages 84.

By including a plurality of intermediate discrete twist waveguide stages, the twist operation becomes smoother, resulting less reflections and thus improving efficiency. As will be appreciated, the specific number of intermediate discrete twist waveguide stages implemented in the waveguide to parallel plate twist transition 62 can vary depending on the application requirements.

A plurality of waveguide-to-parallel-plate twist transition elements 62 arranged adjacent to one another (arrayed) form a waveguide-to-parallel-plate twist transition. Such configuration: 1) enables the wider area of a parallel plate transmission line to be efficiently filled with the electromagnetic wave, 2) allows for controlled excitation of the parallel plate structure through appropriate selection of phase and amplitude excitation of individual waveguide-to-parallel-plate twist transition elements, and 3) allows for scanning of the wave front within the parallel plate structure via appropriate phasing of individual waveguide-to-parallel-plate twist transition elements.

The input waveguide portion 80*a*, output parallel plate portion 82*a* and waveguide 84 may be defined by a length, width and height as required by the specific application. Preferably, the length of the input waveguide portion 80*a*, output parallel plate portion 82*a* and waveguide stage 84*a* are minimized to provide a small overall footprint for the waveguide-to-parallel-plate twist transition element, but should also be sized taking into account higher-order modes with the goal of minimizing reflections of the waveguide-to-parallel plate twist transition as integrated and/or arrayed with applicable input port waveguide tuning network(s) and/or applicable output port parallel plate tuning networks, CTS arrays, or other antenna arrays.

According to one embodiment, a parallel-plate transmission line 10 is formed integral with the output port 82 of the at least one waveguide-to-parallel-plate twist transition element 62. By forming the parallel-plate transmission line 10 integral with the waveguide-to-parallel-plate twist transition elements 62, further space savings can be realized as mounting means for attaching the parallel-plate transmission line 10 to the waveguide-to-parallel-plate twist transition elements 62 is not needed.

Figure 6:
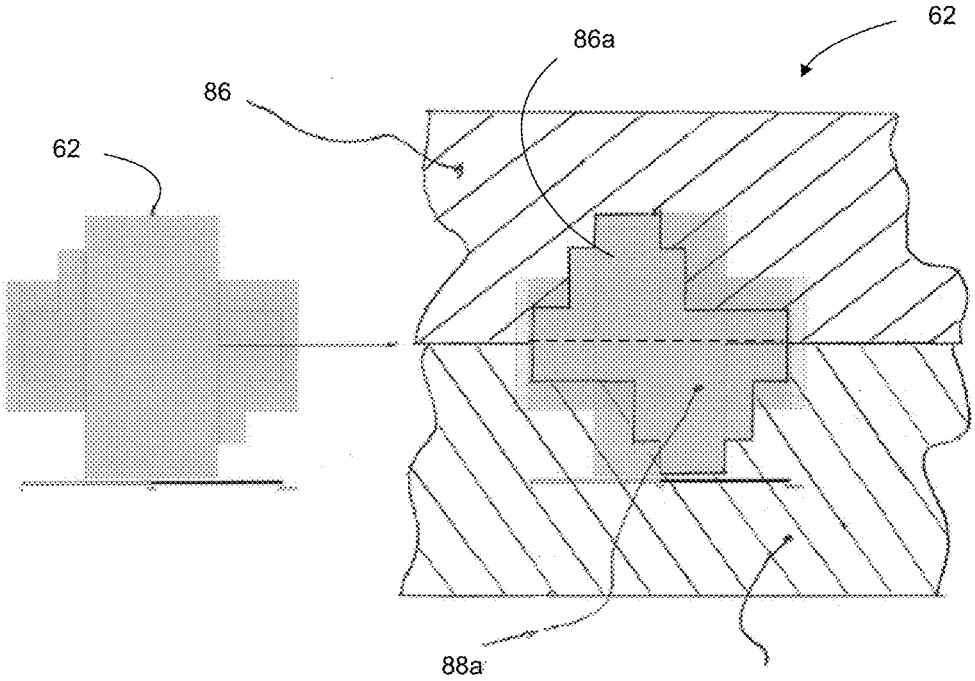
FIG. 6 illustrates a waveguide twist transition and a cross section of the waveguide twist transition when formed in a metal plate.

With reference to FIG. 6, the waveguide-to-parallel-plate twist transition 62 may be formed from a conductive metal plate structure, where the plate may include two pieces, e.g., a first or top plate portion 86 and a second or bottom plate portion 88 that is removeably attachable to the first plate portion. Parts of each of the input port 80, the output port 82 and the at least one intermediate discrete twist waveguide stage 84 can be formed in a part 86*a* of the first plate portion 86, while a remaining part of the input port, the output port and the at least one intermediate discrete twist waveguide stage can be formed in part 88*a* of the second plate portion 88. In this regard, parts of the input port 80, output port 82 and intermediate discrete twist waveguide stage 84 may be machined within the first plate portion 86 and the second plate portion 88, such that when the two plates are mated to one another the complete input port 80, output port 82 and intermediate discrete twist waveguide stage 84 are defined between the two plates (e.g., the air space defined by 86*a* and 88*a* in FIG. 6). Other logical combinations of manufacturing methods (e.g. injection molding the plates with subsequent metalization) are also possible. Further, as shown in FIG. 6, each intermediate discrete twist waveguide stage may optionally be configured as an "approximated" shape of a rectangular waveguide as opposed to a "perfect" rectangle as a means to improve manufacturability and reduce RF reflections of the waveguide-to-parallel plate twist transition as a whole.

Instead of forming the input port 80, output port 82 and intermediate discrete twist waveguide stage 84 in metal plate structures 86, 88, the respective components can be formed in a dielectric material, such as plastic or the like, via an injection molding process or other dielectric forming process. Walls within the resulting structure that define the input port 80, output port 82 and at least one intermediate discrete twist waveguide stage 84 then could be plated with a metal film to provide waveguides through the dielectric material. An advantage of forming the waveguide-to-parallel-plate twist transition via injection molding is that cost and weight can be significantly reduced while still providing comparable performance to that of a structure formed in metal plates.

Moving to FIGS. 7A-7D, illustrated are top, side, front and perspective views, respectively, of a waveguide-to-parallel-plate twist transition element 62 integrally formed with a parallel-plate transmission line 10 using an additional waveguide output port 82 whose E-field is parallel to that of the parallel-plate transmission line 10. Note that the figures are presented in a transparent format to reveal hidden lines. Multiple tuning shapes (grooves, protrusions) are used to effect the necessary "twisting" function of the transition.

As seen in FIGS. 7A-7D, a waveguide 90 feeds the waveguide portion 80*a* of the input port 80 with an electromagnetic wave. The input port 80 and waveguide portion 80*a* may be separate from the waveguide 90, or may form an end portion of the waveguide 90. The input port 80, via the waveguide portion 80*a*, provides the electromagnetic wave to the at least one intermediate discrete twist waveguide stage 84 with an E-field having a first orientation. The at least one intermediate discrete twist waveguide stage 84 then alters an orientation of the E-field as described herein, and provides the electromagnetic wave to the waveguide portion 82*a* of the output port 82. The waveguide port 82*a* further alters the E-field of the electromagnetic wave as described herein, and provides the electromagnetic wave to the parallel-plate transmission line 10. The result is the E-field of the electromagnetic wave has its orientation, as provided by the input port 80, changed relative to the E-field as output by the output port 82. As noted earlier, in some embodiments, output port 82 may be in the form of a parallel plate in lieu of a waveguide, further compacting the transition.

Figure 7A:
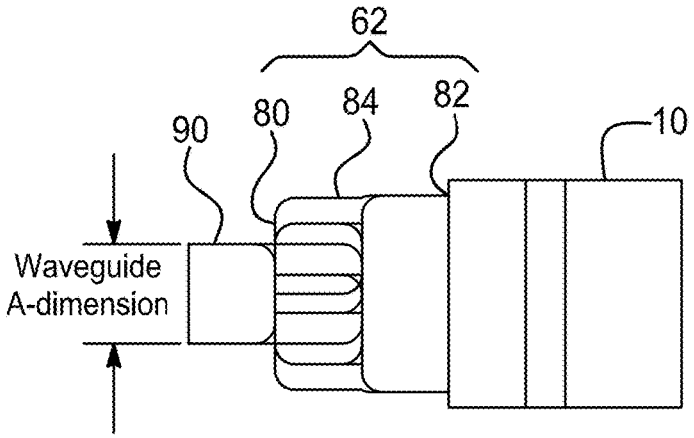
FIGS. 7A, 7B and 7C are top, side and front views of a waveguide twist transition coupled to a waveguide and to a parallel-plate transition that includes a waveguide twist transition in accordance with the present disclosure.
Figure 7B:
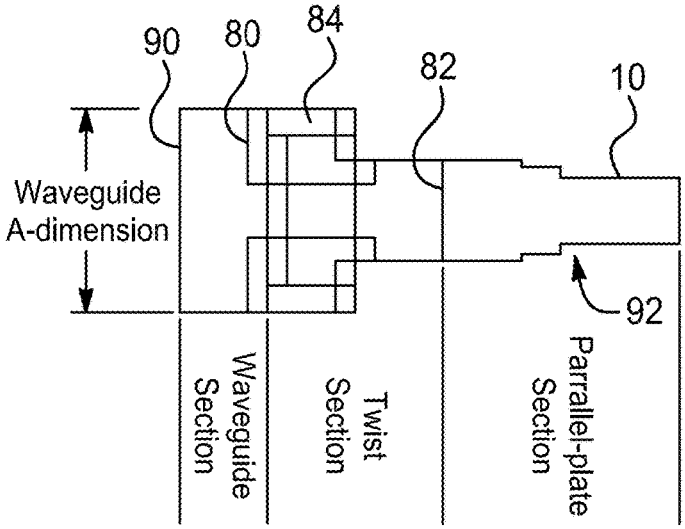
Figure 7C:
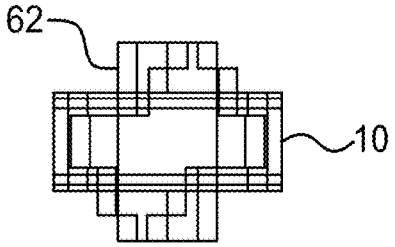
Figure 7D:
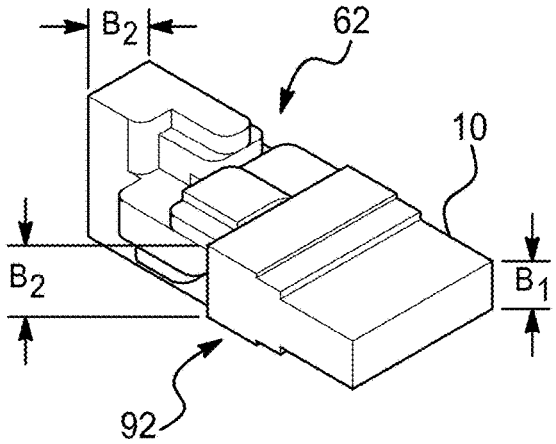
FIG. 7D is a perspective view of a waveguide twist transition formed with a parallel-plate transmission line in accordance with the present disclosure.
Figure 8A:
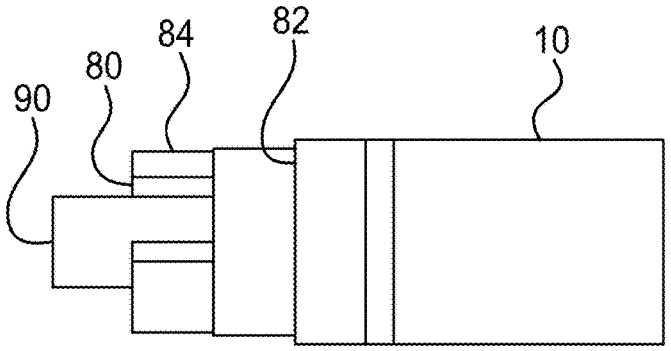
FIGS. 8A, 8B, 8C and 8D correspond to FIGS. 7A, 7B, 7C and 7D respectively, with fillets removed.
Figure 8B:
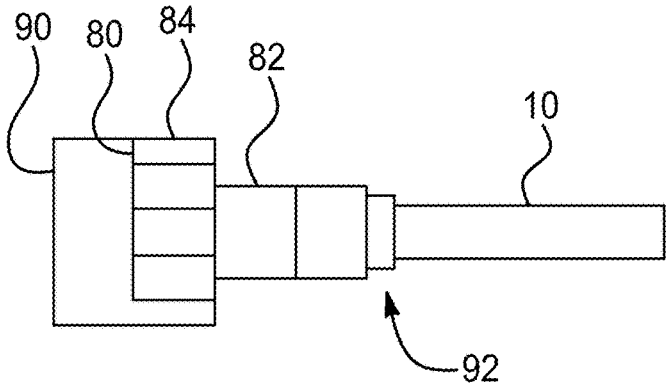
Figure 8C:
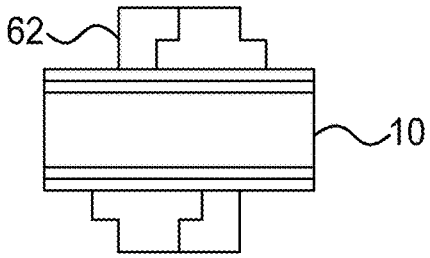
Figure 8D:
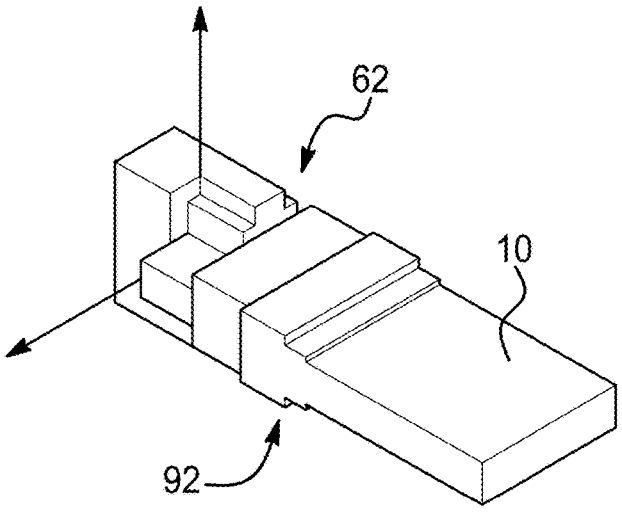

The parallel-plate transmission line 10 may optionally include transformer sections 92 to transition from the parallel plate B-dimension to a convenient waveguide narrow wall B-dimension that is consistent with a desired frequency band of interest. FIG. 7D shows an isometric view where the transformer sections 92 can be seen. The B dimension is the gap separating the upper and lower parallel-plate conductors (see FIG. 7D). In one embodiment, the B-dimension of the parallel plate transmission line 10 is different from the B-dimension of the parallel plate on the output port 82 of the waveguide-to-parallel-plate twist transition elements.

Figure 9:
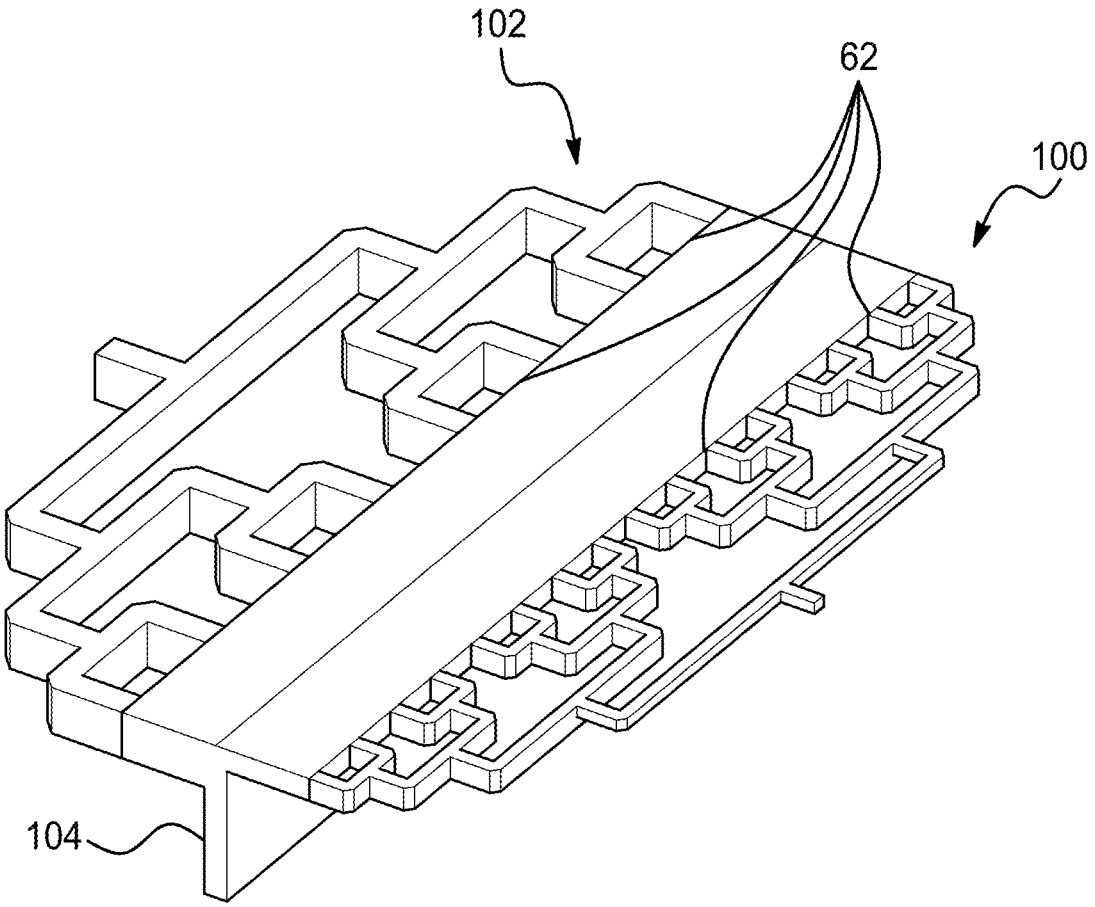
FIG. 9 is a schematic diagram of two waveguide corporate feeds feeding a parallel-plate transmission line via an array of waveguide-to-parallel plate twist transitions in accordance with the present disclosure.

FIG. 9 shows an embodiment that includes two waveguide corporate feeds 100, 102 (one dedicated to low-band operation and a second dedicated to high-band operation) each supporting two separate frequency bands feeding a parallel plate diplexer 104 from opposite ports. Each feed network is comprised of a series of E-plane bends and Tee's that constructively combine the RF fields into a single waveguide port, and each uses a linear array of twist transitions 62 to couple from waveguide 100, 102 to parallel plate 104. The waveguide twist transition 62 as described herein can be used to reduce the size of the structure of FIG. 9.

Other embodiments comprising arbitrary feed networks or combinations of arbitrary feeding networks to combine an arbitrary number of Waveguide to Parallel-Plate Transitions with arbitrary tuning networks are possible.

The described invention can be employed in a Variable Inclination Continuous Transverse Stub ('VICTS') and/or Continuous Transverse Stub ('CTS') antenna arrays and more generally in any antenna feed that employs parallel-plate fed with two or more waveguides. Immediate and future applications include X-, K-, Ka-, Q-, V- and W-band phased array antennas, VICTS arrays and CTS arrays. Immediate and future applications include Fixed, Ground-Mobile, and Aeronautical embodiments of CTS and VICTS arrays for sensors and communications.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A waveguide-to-parallel-plate twist transition, comprising:

at least two waveguide-to-parallel plate twist transition elements arranged adjacent to each other, the at least two waveguide-to-parallel plate twist transition elements including i) an input port having an input waveguide portion, the input waveguide portion configured to orient an E-field of an electromagnetic wave received by the input port along a first plane;

ii) an output port comprising a multi-mode parallel plate transmission line portion, the multi-mode parallel plate transmission line portion configured to orient an E-field of an electromagnetic wave received by the output port along a second plane, wherein an angle of orientation of the second plane is different from an angle of orientation of the first plane; and iii) at least one intermediate discrete twist waveguide stage coupling the input waveguide portion to the output multi-mode parallel plate transmission line portion, wherein the at least one intermediate discrete twist waveguide stage is configured to orient an E-field of an electromagnetic wave received by the at least one intermediate discrete twist waveguide stage along a third plane, wherein an angle of orientation of the third plane is between the angle of orientation of the first plane and the angle of orientation of the second plane.

2. The waveguide-to-parallel-plate twist transition according to claim 1, wherein the first plane is orthogonal to the second plane.

3. The waveguide-to-parallel-plate twist transition according to claim 1, wherein the at least one waveguide-to-parallel plate twist transition element comprises a plurality of intermediate discrete twist waveguide stages, and each intermediate discrete twist waveguide stage of the plurality of intermediate discrete twist waveguide stages is configured to orient an E-field of an electromagnetic wave received by the respective intermediate discrete twist waveguide stage along a respective plane, wherein for each of the intermediate discrete twist waveguide stages an angle of orientation of the respective plane is different from an angle of orientation of other planes of the plurality of intermediate discrete twist waveguide stages.

4. The waveguide-to-parallel-plate twist transition according to claim 3, wherein each of the intermediate discrete twist waveguide stages orients the E-field at (K/(1+N)) degrees relative to an E-field orientation of an immediately adjacent intermediate discrete twist waveguide stage, where K is the angle between the input port and the output port and N is the number of intermediate discrete twist waveguide stages.

5. The waveguide-to-parallel-plate twist transition according to claim 1, wherein the at least one intermediate discrete twist waveguide stage orients the E-field at 45 degrees relative to an orientation of the E-field for the immediately adjacent input port or output port.

6. The waveguide-to-parallel-plate twist transition according to claim 1, wherein at least one intermediate discrete twist waveguide stage comprises at least one of a rectangular or elliptical waveguide.

7. The waveguide-to-parallel-plate twist transition according to claim 1, wherein the waveguide to parallel plate twist transition is formed in a plate structure.

8. The waveguide-to-parallel-plate twist transition according to claim 7, wherein the plate structure comprises a first plate portion and a second plate portion removably attachable to the first plate portion.

9. The waveguide to parallel plate twist transition according to claim 8, wherein a first portion of the input port, a first portion of the output port and a first portion of the at least one intermediate discrete twist waveguide stage are each formed in the first plate structure, and wherein a second portion of the input port, a second portion of the output port and a second portion of the at least one intermediate discrete twist waveguide stage are each formed in the second plate structure.

10. The waveguide-to-parallel-plate twist transition according to claim 1, wherein the input waveguide portion, intermediate discrete twist waveguide stages, and multi-mode parallel plate transmission line portion are formed in a dielectric material.

11. The waveguide-to-parallel-plate twist transition according to claim 10, wherein interior walls of the input waveguide portion, output parallel plate portion and the at least one intermediate discrete twist waveguide stage comprise a metal plating.

12. The waveguide-to-parallel-plate twist transition according to claim 1, wherein a parallel-plate transmission line is formed integral with the plurality of waveguide-to-parallel plate twist transition elements.

13. The waveguide-to-parallel-plate twist transition according to claim 12 wherein a B-dimension of the parallel plate transmission line is different from a B-dimension of the parallel plate on the output port of the waveguide-to-parallel-plate twist transition elements.

14. The waveguide-to-parallel-plate twist transition according to claim 1, wherein the output port comprises an output waveguide portion arranged between the at least one intermediate discrete twist waveguide stage and the multi-mode parallel-plate transmission line portion, the output waveguide portion having the same E-field orientation as the multi-mode parallel plate transmission line portion and coupling the at least one intermediate discrete twist waveguide stage to the multi-mode parallel-plate transmission line portion.

15. A waveguide-to-parallel-plate twist transition, comprising:

at least one waveguide-to-parallel plate twist transition element including i) an input port having an input waveguide portion, the input waveguide portion configured to orient an E-field of an electromagnetic wave received by the input port along a first plane;

ii) an output port comprising a multi-mode parallel plate transmission line portion, the multi-mode parallel plate transmission line portion configured to orient an E-field of an electromagnetic wave received by the output port along a second plane, wherein an angle of orientation of the second plane is different from an angle of orientation of the first plane; and iii) at least one intermediate discrete twist waveguide stage coupling the input waveguide portion to the output multi-mode parallel plate transmission line portion, wherein the at least one intermediate discrete twist waveguide stage is configured to orient an E-field of an electromagnetic wave received by the at least one intermediate discrete twist waveguide stage along a third plane, wherein an angle of orientation of the third plane is between the angle of orientation of the first plane and the angle of orientation of the second plane, wherein the output port comprises an output waveguide portion arranged between the at least one intermediate discrete twist waveguide stage and the multi-mode parallel-plate transmission line portion, the output waveguide portion having the same E-field orientation as the multi-mode parallel plate transmission line portion and coupling the at least one intermediate discrete twist waveguide stage to the multi-mode parallel-plate transmission line portion.

16. A waveguide-to-parallel-plate twist transition, comprising:

at least one waveguide-to-parallel plate twist transition element including i) an input port having an input waveguide portion, the input waveguide portion configured to orient an E-field of an electromagnetic wave received by the input port along a first plane;

ii) an output port comprising a multi-mode parallel plate transmission line portion, the multi-mode parallel plate transmission line portion configured to orient an E-field of an electromagnetic wave received by the output port along a second plane, wherein an angle of orientation of the second plane is different from an angle of orientation of the first plane; and iii) at least one intermediate discrete twist waveguide stage coupling the input waveguide portion to the output multi-mode parallel plate transmission line portion, wherein the at least one intermediate discrete twist waveguide stage is configured to orient an E-field of an electromagnetic wave received by the at least one intermediate discrete twist waveguide stage along a third plane, wherein an angle of orientation of the third plane is between the angle of orientation of the first plane and the angle of orientation of the second plane, wherein the waveguide to parallel plate twist transition is formed in a plate structure comprising a first plate portion and a second plate portion removably attachable to the first plate portion, wherein a first portion of the input port, a first portion of the output port and a first portion of the at least one intermediate discrete twist waveguide stage are each formed in the first plate structure, and a second portion of the input port, a second portion of the output port and a second portion of the at least one intermediate discrete twist waveguide stage are each formed in the second plate structure.

* * * * *